US007568460B2

(12) United States Patent
Schmidt

(10) Patent No.: US 7,568,460 B2
(45) Date of Patent: Aug. 4, 2009

(54) VARIABLE VALVE DRIVE OF AN INTERNAL COMBUSTION ENGINE

(75) Inventor: Volker Schmidt, Burgbernheim (DE)

(73) Assignee: Schaeffler KG, Herzogenaurach (DE)

( * ) Notice: Subject to any disclaimer, the term of this patent is extended or adjusted under 35 U.S.C. 154(b) by 110 days.

(21) Appl. No.: 11/718,678

(22) PCT Filed: Oct. 12, 2005

(86) PCT No.: PCT/EP2005/010943

§ 371 (c)(1),
(2), (4) Date: Jun. 28, 2007

(87) PCT Pub. No.: WO2006/048100

PCT Pub. Date: May 11, 2006

(65) Prior Publication Data

US 2008/0115749 A1 May 22, 2008

(30) Foreign Application Priority Data

Nov. 4, 2004 (DE) ..... 10 2004 053 203

(51) Int. Cl.
*F01L 1/18* (2006.01)

(52) U.S. Cl. ..... 123/90.45; 123/90.39; 123/90.44; 123/90.46; 74/569

(58) Field of Classification Search ..... 123/90.39, 123/90.44, 90.45, 90.46, 90.48, 90.5, 90.52; 74/559, 567, 569
See application file for complete search history.

(56) References Cited

U.S. PATENT DOCUMENTS

| | | | | |
|---|---|---|---|---|
| 3,385,274 A | | 5/1968 | Shunta et al. | |
| 3,439,661 A | | 4/1969 | Weiler | |
| 4,350,129 A | | 9/1982 | Nakajima et al. | |
| 4,502,425 A | * | 3/1985 | Wride | 123/90.12 |
| 5,161,500 A | * | 11/1992 | Kubis et al. | 123/321 |
| 5,451,029 A | | 9/1995 | Kruger | |
| 5,692,469 A | | 12/1997 | Rammer et al. | |

FOREIGN PATENT DOCUMENTS

| | | |
|---|---|---|
| DE | 4000531 | 6/1990 |
| DE | 4102537 | 7/1992 |
| DE | 4317607 | 12/1993 |
| DE | 4318293 | 12/1993 |
| JP | 63297710 | 12/1988 |
| WO | 8202574 | 8/1982 |

* cited by examiner

*Primary Examiner*—Ching Chang
(74) *Attorney, Agent, or Firm*—Volpe and Koenig, P.C.

(57) ABSTRACT

A variable valve drive (1) of an internal combustion engine is provided which is used to actuate a gas exchange valve (5). Displacement thereof takes place via a cam (7) generated lift and via a lift generated by a piston (14, 32) of a hydraulic force applying device (4*a*, 4*b*), which is superimposed on the cam lift and which is independent thereof. The hydraulic force applying device is connected to a hydraulic fluid line (S-P) which provides an adjustable hydraulic pressure medium and includes a pressure chamber (24*a*, 24*b*) which is limited on one side by the piston (14, 32), in addition to a hydraulic valve lash compensation device (23*a*, 23*b*) which includes a working chamber (22*a*, 22*b*) which is radially defined by a housing (13*a*, 13*b*). The housing (13*a*, 13*b*) is also used to radially define the pressure chamber (24*a*, 24*b*).

8 Claims, 2 Drawing Sheets

20
14
15
4a
18
S-P
27
S-LA
21
28, 29
3a
30
B
24a
19
26
16, 25
17
13a
12
22a
23a
7
11
10
1, 2
9
8
6
A
3a
5

VARIABLE VALVE DRIVE OF AN INTERNAL COMBUSTION ENGINE

BACKGROUND

The invention relates to a variable valve drive of an internal combustion engine for actuating a gas-exchange valve. Its motion follows a lift of a cam and also a lift of a piston of a hydraulic force-applying device superimposed on the lift of the cam and independent of the lift of the cam. This is connected to a hydraulic medium line with adjustable hydraulic medium pressure and has a pressure chamber charging the piston and also a hydraulic valve lash compensating device with a work chamber limited radially by a housing.

Valve drives according to this class are known in the state of the art. For example, DE 43 18 293 A1 discloses a hydraulic force-applying device on a finger lever drive with a pivot support, which pivotably supports a finger lever actuated by a cam in the actuation direction of the gas-exchange valve. The hydraulic force-applying device here expands the functionality of a hydraulic valve lash compensating device by a hydraulic lift, which is variably adjustable and which is superimposed on the mechanical lift given by the cam on the gas-exchange valve. Through this superimposition, on one hand, a reduction of the gas-exchange valve lift in terms of maximum lift and/or opening period up to complete standstill of the gas-exchange valve is possible. On the other hand, by superimposing the hydraulic and the mechanical lift, an expansion of the lift generated by the cam in the sense of an earlier opening time or a later closing time or an increased maximum lift or combinations of the like are possible.

For realizing this functionality, the publication noted above proposes an essentially conventional pivot support common for someone skilled in the art with hydraulic valve lash compensation. This pivot support is guided so that it can move longitudinally in an additional outer housing, which is supported in a recess of the internal combustion engine. Here, a bottom side of the pivot support, together with an inner wall of the outer housing, comprises a pressure chamber, which is connected to a pressure-adjustable hydraulic medium line.

Although the use of a conventional pivot support, which is to be modified, if necessary, based on changed movement and installation relationships, promises acceptable production costs of the hydraulic force-applying device, on one hand the increased installation requirements in terms of diameter and length are disadvantageous due to the addition of additional wall thickness. Such an extension of the diameter and length is to be viewed as critical for modern installation-limited internal combustion engines, because the wall thickness between the receptacle bore is already small for supporting the pivot support and adjacent hollow spaces, for example, charge changing and cooling water channels or spark plug shafts, and permit less play for an extension of the diameter or length of the receptacle bore.

Another disadvantageous aspect given with the use of such a pivot support is the increase in the mass of the moving valve drive components. Thus, it is necessary for a hydraulic force-applying device according to the cited publication that the pivot support must be incorporated completely in the hydraulic lift that is sometimes characterized by high acceleration values. The mass of the pivot support moved at the same time thus requires either a limitation of these acceleration values to values that worsen the quality of the charge change or a high hydraulic drive output is necessary for achieving high acceleration values of the hydraulic lift. The latter must be applied, however, in a direct or indirect way by the internal combustion engine itself and is to be limited to a minimum with respect to a tolerable increase in the frictional output of the internal combustion engine.

The described disadvantages incidentally do not apply just for the cited finger lever drive, but instead also for other valve drive constructions. This applies to a greater degree for valve drives, in which the components of the hydraulic force-applying device also follow the mechanical lift of the cam, as is the case, for example, for cup-tappet drives. In this respect, an increase in the moving mass would have a disadvantageous effect, in particular, on the achievable acceleration values of the valve drive.

SUMMARY

Therefore, the present invention is based on the objective of improving a valve drive of the type noted above, such that the listed disadvantages are avoided. The hydraulic force-applying device should be distinguished, first, through minimal installation requirements, so that it can also be used in modern installation-limited internal combustion engines. Second, its moving components should have the smallest possible mass, in order to actuate the gas-exchange valve with the highest possible acceleration values. The force-applying device should finally be able to be manufactured as economically as possible with lower complexity.

The objectives are met using the features of the invention, while advantageous improvements and constructions can be taken from the following description.

Accordingly, the objectives are met in that the housing is simultaneously used for radially limiting the pressure chamber. In the valve drive according to the invention, the hydraulic force-applying device is constructed, such that the work chamber of the hydraulic valve lash compensating device and the pressure chamber are limited radially by a common housing. Therefore, the necessity for a separate outer housing, whose wall thickness would lead to a considerable addition to the diameter and length of the force-applying device, is eliminated. Its minimal installation requirements thus allow excellent adaptability of the valve drive according to the invention in already existing internal combustion engines. Simultaneously, through the low complexity of the hydraulic force-applying device, cost-effective manufacturability is given.

Moreover, due to the small number of components in the force-applying device, the mass of the moving components is small, so that good acceleration values can be achieved for the actuation of the gas-exchange valve. Simultaneously, the expense for generating the hydraulic drive power with reference to good efficiency of the internal combustion engine can be kept to a low level.

One especially advantageous construction of the valve drive according to the invention provides that the pressure chamber is limited axially by the piston and a first end side facing the piston in a compensating piston of the hydraulic valve lash compensating device guided so that it can move longitudinally in the housing.

In this way, the work chamber of the hydraulic valve lash compensating device is arranged separate from the pressure chamber and is limited axially by a second end side of the compensating piston facing away from the piston. So that the work chamber is not expanded by the volume of the hydraulic medium line, outstanding stiffness is given for the hydraulic valve lash compensating device. Finally, proven components of conventional mass-production technology can be used. For example, it is possible to further use the restoring spring of the hydraulic valve lash compensating device designed for the relatively small lift of the compensating piston.

A preferred construction of the valve drive constructed according to a further preferred embodiment that the compensating piston is constructed as a hollow body. In this way, a sufficiently large reservoir for hydraulic medium is created, which must be recirculated into the work chamber in a correspondingly large amount, in particular, when the compensating piston moves out of its lowered position into its work position, as can occur when the internal combustion engine starts up.

As an alternative embodiment it can also be useful, however, that the pressure chamber is identical to the work chamber of the hydraulic valve lash compensating device. An advantage of this construction is that, first, the piston can be used as a large-volume hydraulic medium reservoir for supplying the work chamber of the hydraulic valve lash compensating device. Second, it can be advantageous, depending on production, to produce the piston in one piece together with the compensating piston.

For a hydraulic force-applying device according to this embodiment, the hydraulic valve lash compensating device should be connected to a hydraulic medium supply independent of the hydraulic medium line.

Such a partitioning of the hydraulic supply is then free from additional expenses especially when no gas-exchange valves of the internal combustion engine are also actuated by a hydraulic force-applying device and a hydraulic medium supply already exists anyway for supplying adjacent and exclusively cam-actuated valve drives.

According to another embodiment of the invention, the valve drive should allow at least one secondary lift of the gas-exchange valve during a lift-free base-circle phase of the cam. This produces advantageous possibilities for recirculating exhaust gas internally in high quantities and precisely adjustable doses. This form of exhaust gas recirculation is the basis, in particular, for an operation of the internal combustion engine for homogeneous and self-igniting charging. Such a combustion process, also designated as the HCCI process (Homogeneous Charge Compression Ignition) can be used both for self-ignited diesel combustion engines and also for externally ignited Otto combustion engines at least in the partial load operation of the internal combustion engine mainly for the purpose of reducing emissions. The combustion sequence is set in the HCCI process essentially through the control of the charge composition and the charge temperature profile. For this combustion process, it has been shown that a high charge temperature is desired for controlling the ignition time. A very effective means for increasing the charge temperature is increasing the residual gas content, i.e., increasing the content of non-flushed exhaust gas and flushed exhaust gas recirculated back into the cylinder from the preceding combustion cycle into the cylinder charging for the next combustion cycle. Here, the residual gas content must be able to be adapted completely variably to the operating point of the internal combustion engine, wherein residual gas percentages of 60% of the cylinder charge and more can be necessary. Residual gas percentages at this level can no longer be provided by means of internal exhaust gas recirculation through conventional valve overshooting or by means of a device for external exhaust gas recirculation. Moreover, the HCCI process reacts with unacceptable combustion sequences in an extremely sensitive way to changes in the charging properties, so that, in addition to providing residual gas in the necessary amount, a combustion cycle-consistent, highly precise, and cylinder-specific dosing of the residual gas percentage is also necessary.

The secondary lift takes place according to another embodiment of the invention preferably for an exhaust valve. In the case of the exhaust gas recirculation explained above, exhaust gas already displaced into the outlet channel is recirculated into the combustion chamber via the then still open exhaust valve during the suction cycle of the internal combustion engine. In contrast, however, there is also the possibility to operate the valve drive according to the invention as an engine brake, in particular, for air-compressing internal combustion engines as a safety-related expansion of the operating brake. Such engine braking is typically used for long-duration braking in commercial vehicles and is based on the principle that the drag moment of the internal combustion engine in engine-braking and coasting mode can be considerably increased by increasing the charge changing work and the vehicle is therefore braked. In this case, the exhaust valve is still open during the compression phase, so that the cylinder charge is not compressed like a pneumatic spring action, but instead is pushed into the outlet channel under the application of displacement work.

In terms of the exhaust gas recirculation, however, it can also be useful that the secondary lift takes place on an intake valve. In this alternative construction, exhaust gas is displaced into the inlet channel in the thrust cycle of the internal combustion engine for a still open intake valve and recirculated into the combustion chamber during the suction cycle.

A combination of these previously mentioned possibilities of exhaust gas recirculation is also possible. Accordingly, for setting the amount and temperature of the residual gas it can be advantageous to recirculate this gas both from the inlet channel and also from the outlet channel.

Another preferred construction of the valve drive provides that wherein the valve drive is constructed as a finger lever drive and the hydraulic force-applying device is constructed as a pivot support.

For the sake of simplicity, preferably the lubricating oil of the internal combustion engine is used as the hydraulic medium. In contrast, however, the use of any other suitable fluid in a hydraulic medium circuit, which would then be separated from the lubricating oil circuit of the internal combustion engine, is also conceivable.

BRIEF DESCRIPTION OF THE DRAWINGS

Additional features of the invention emerge from the following description and from the drawings, in which the valve drive according to the invention is illustrated as an example with reference to a cam follower drive with two differently constructed pivot supports of the hydraulic force-applying device. Shown are.

DETAILED DESCRIPTION OF THE PREFERRED EMBODIMENTS

Figures 1, 2:
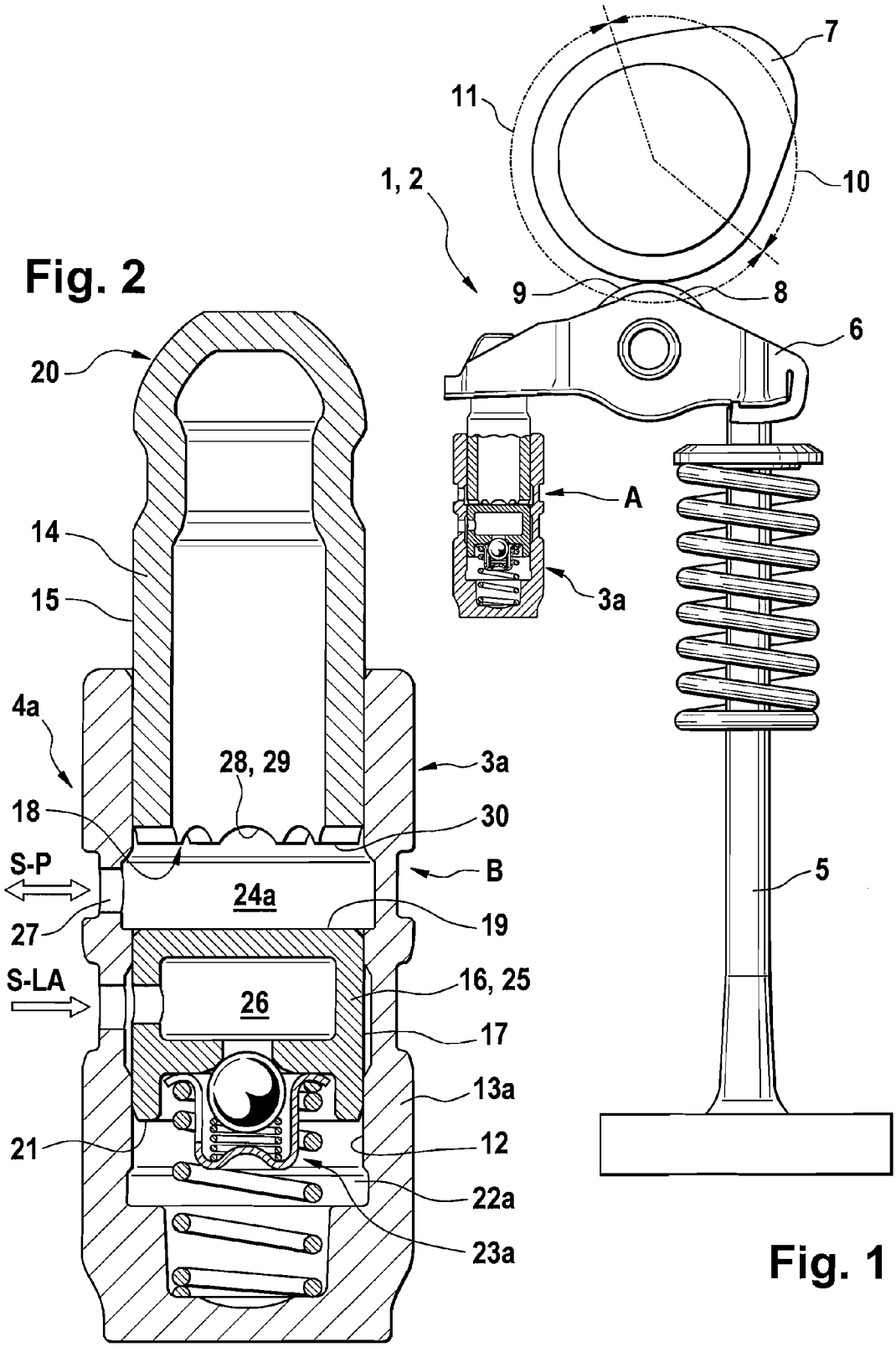
FIG. 1 a view of the cam follower operation for a closed gas exchange valve with a first longitudinally sectioned pivot support, FIG. 2 an enlarged representation of the pivot support according to FIG. 1, FIG. 3 a view of the cam follower operation for a closed gas-exchange valve with a second longitudinally sectioned pivot support, FIG. 4 an enlarged representation of the pivot support according to FIG. 3.

In FIGS. 1 and 2, the valve drive 1 according to the invention is disclosed using the example of a finger lever drive 2 with a pivot support 3*a* as a component of a hydraulic force-applying device 4*a*. A gas-exchange valve 5, which is actuated via a finger lever 6 by a cam 7 in the opening direction, is shown. The finger lever 6 is supported on the pivot support 3*a* in the actuation direction of the gas-exchange valve 5 and provides a rotatably supported roller 8 as a low-friction contact surface 9 to the cam 7. The cam 7 has a cam lifting phase 10, which generates a lift on the gas-exchange valve 5, and a lift-free base-circle phase 11.

A piston 14 with an outer casing surface 15 and also a compensating piston 16 with an outer casing surface 17 are guided so that they can move longitudinally in an inner casing surface 12 of a hollow cylindrical housing 13*a*. A first end section 18 of the piston 14 is turned towards a first end side 19 of the compensating piston 16, while a second end section 20 of the piston 14 has a spherical construction for supporting the cam follower 6 so that it can pivot. A second end side 21 of the compensating piston 16 facing away from the piston 14 limits a work chamber 22*a* of a hydraulic valve lash compensating device 23*a*. The piston 14 can be spaced away from the first end side 19 of the compensating piston 16 and, together with this, limits a variable-volume pressure chamber 24*a* of the hydraulic force-applying device 4*a*.

The valve lash compensating device 23*a* connects to a hydraulic medium supply "S-LA". The compensating piston 16 is usefully constructed as a hollow body 25, in order to separate the pressure chamber 24*a* from the work chamber 22*a* of the valve lash compensating device 23*a* and simultaneously to create a hydraulic medium reservoir 26 for the work chamber 22*a*.

The pressure chamber 24*a* is connected via at least one passage opening 27 in the housing 13*a* to a hydraulic medium line "S-P", whose hydraulic medium pressure is adjustable. In FIG. 1, the pivot support 3*a* assumes a base position "A", in which the piston 14 contacts with its first end section 18 the first end side 19 of the compensating piston 16 for low hydraulic medium pressure in the hydraulic medium line "S-P". The gas-exchange valve 5 is here closed, because the cam 7 simultaneously contacts the roller 8 in its base-circle phase 11.

The hydraulic force-applying device 4*a* generates a lift of the gas-exchange valve 5 superimposed on the lift of the cam 7, in that the volume of the pressure chamber 24*a* is enlarged by increasing the hydraulic medium pressure in the hydraulic medium line "S-P". Simultaneously, the piston 14 distances itself away from the compensating piston 16 and actuates the cam follower 6 independent of the lift of the cam 7 in the opening direction of the gas-exchange valve 5. This situation is shown in FIG. 2 for a lift position "B" of the piston 14.

A subsidence of the lift of the gas-exchange valve 5 generated by the hydraulic force-applying device 4*a* is introduced by the return of the piston 14 into its base position "A". For this purpose, the hydraulic medium line "S-P" is operated as a discharge line for reducing the volume of the pressure chamber 24*a*.

A prerequisite for a large time cross section of the lift generated by the hydraulic force-applying device 4*a* on the gas-exchange valve 5 is the quickest possible movement of the piston 14 between the base position "A" and the lift position "B" and thus a quick volume change of the pressure chamber 24*a*. As already mentioned, the piston 14 is located in its base position "A" with its first end section 18 in contact with the first end side 19 of the compensating piston 16. In this respect, for a low-resistance feed and discharge of the hydraulic medium into or out of the pressure chamber 24*a* it is useful that the piston 14 has on its first end section 18 at least one passage 28 for hydraulic medium. This passage 28 can be constructed according to the drawing as a depression 29, which breaks an end surface 30 of the first end section 15 of the piston 14 essentially parallel to the first end side 19 of the compensating piston 16. It is alternatively or additionally also possible to connect the pressure chamber 24*a* via a passage with closed contours opening into the outer casing surface 15 of the hollow cylindrical piston 14.

Figures 3, 4:
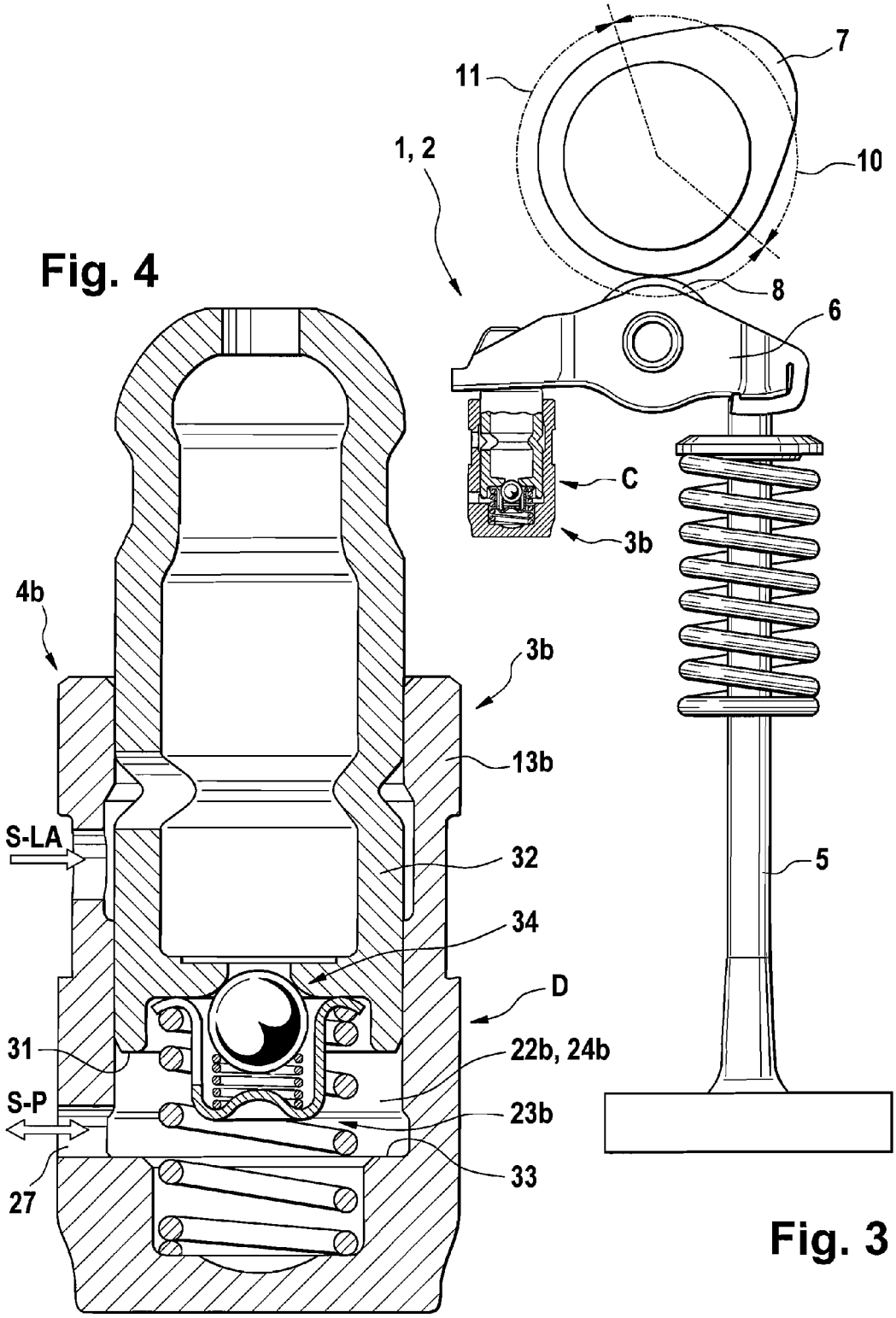

FIGS. 3 and 4 disclose the valve drive 1 according to the invention with a pivot support 3*b*, which differs in comparison with the pivot support 3*a* of FIGS. 1 and 2 essentially by grouping a work chamber 22*b* of a valve lash compensating device 23*b* with a pressure chamber 24*b* of a hydraulic force-applying device 4*b*. The following description is therefore limited to the representation of the essential feature differences between the two embodiments.

In FIG. 3, the pivot support 3*b* is shown in a base position "C". The base position "C" corresponds to an installation position of the hydraulic valve lash compensating device 23*b* and is therefore characterized in that an end surface 31 of a piston 32 facing away from the cam follower 6 is slightly distanced away from a shoulder 33 of a housing 13*b*. Here, the piston 32 is used for the axial limiting of the work chamber 22*b* that is identical to the pressure chamber 24*b*. Thus, the work chamber 22*b* is also connected to the hydraulic medium line "S-P" via a passage opening 27 in the housing 14*b* for the purpose of changing the volume of the pressure chamber 24*b*.

The piston 32 is shown in FIGS. 3 and 4 as a one-piece piston 32, which is simultaneously used for supporting the cam follower 6 so that it can pivot. However, the use of a multiple-piece piston is also equally possible, wherein an upper part supports the cam follower 6 and a lower part is used for limiting the pressure chamber 24*b* in common with the work chamber 22*b*.

In FIG. 4, the pivot support 3*b* is shown for a lift position "D" with significantly increased distance of the end surface 31 of the piston 32 to the shoulder 33 of the housing 13*b*. For the return of the piston 32 from this lift position "D" the hydraulic medium line "S-P" is operated, in turn, as a discharge line. The hydraulic medium line "S-P", however, is then to be closed for the pivot support 3*b* at the latest when the cam lifting phase 11 comes in contact with the roller 8, in order to maintain the function of the valve lash compensating device 23*b*.

The valve lash compensating device 23*b* can finally be supplied in a known way via a non-return valve 34, which connects the hydraulic medium supply "S-LA" to the work chamber 22*b* independent of the hydraulic medium line "S-P".

The valve drive 1 according to the invention has been explained using the example of a finger lever valve drive 2 as a preferred embodiment. The concept according to the invention, however, can be transferred equally to other valve drive constructions, for example, for cup tappet drives or tappet rod drives. Furthermore, the scope of protection of the invention should also include valve drives with a switchable construction through coupling means, in order to be able to transfer lifts of several cams as a function of the coupling state selectively to the gas-exchange valve 6. This applies equally for valve drives that continuously vary the lift of the gas-exchange valve 6 by means of a cam and other adjustment elements.

LIST OF REFERENCE NUMBERS AND SYMBOLS

1 Valve drive
2 Finger lever drive
3*a* Pivot support
3*b* Pivot support
4*a* Force-applying device

4*b* Force-applying device
5 Gas-exchange valve
6 Finger lever
7 Cam
8 Roller
9 Contact surface
10 Cam lifting phase
11 Base-circle phase
12 Inner casing surface
13*a* Housing
13*b* Housing
14 Piston
15 Outer casing surface
16 Compensating piston
17 Outer casing surface
18 First end section
19 First end side
20 Second end section
21 Second end side
22*a* Work chamber
22*b* Work chamber
23*a* Valve lash compensating device
23*b* Valve lash compensating device
24*a* Pressure chamber
24*b* Pressure chamber
25 Hollow body
26 Hydraulic medium reservoir
27 Passage opening
28 Passage
29 Recess
30 End surface
31 End surface
32 Piston
33 Shoulder
34 Non-return valve
A-LA Hydraulic medium supply
S-P Hydraulic medium line
A Base position
B Lift position
CBase position
D Lift position

The invention claimed is:

1. A variable valve drive of an internal combustion engine for actuating a gas-exchange valve, whose movement follows a lift of a cam, comprising a hydraulic force applying device having a lift that is superimposed on the lift of the cam and which is independent of the lift of the cam, the hydraulic force-applying device including a piston which is connected to a hydraulic medium line with adjustable hydraulic medium pressure and a pressure chamber at least indirectly pressurizing the piston and also a hydraulic valve lash compensating device with a work chamber radially limited by a housing, wherein the housing is used simultaneously for radial limiting of the pressure chamber, and the pressure chamber is limited axially by the piston and a first end side of a compensating piston of the valve lash compensating device that faces the piston and is guided so that it can move longitudinally in the housing, a second end side of the compensating piston facing away from the piston axially limits the work chamber of the valve lash compensating device separated from the pressure chamber.

2. The variable valve drive according to claim 1, wherein the compensating piston is constructed as a hollow body.

3. The variable valve drive according to claim 1, wherein the valve lash compensating device is connected to a hydraulic medium supply independent of the hydraulic medium line.

4. The variable valve drive according to claim 1, wherein the gas-exchange valve executes at least one secondary lift during a base-circle phase of the cam.

5. The variable valve drive according to claim 4, wherein the gas-exchange valve is an exhaust valve of the internal combustion engine.

6. The variable valve drive according to claim 4, wherein the gas-exchange valve is an intake valve of the internal combustion engine.

7. The variable valve drive according to claim 1, wherein the hydraulic medium is lubricating oil of the internal combustion engine.

8. A variable valve drive of an internal combustion engine for actuating a gas-exchange valve, whose movement follows a lift of a cam, comprising a hydraulic force applying device having a lift that is superimposed on the lift of the cam and which is independent of the lift of the cam, the hydraulic force-applying device including a piston which is connected to a hydraulic medium line with adjustable hydraulic medium pressure and a pressure chamber at least indirectly pressurizing the piston and also a hydraulic valve lash compensating device with a work chamber radially limited by a housing, wherein the housing is used simultaneously for radial limiting of the pressure chamber, and the valve drive is constructed as a cam follower drive and the force-applying device is constructed as a pivot support wherein the housing is supported in a hollow cylindrical recess of the internal combustion engine.

* * * * *